US011430372B2

(12) United States Patent
Xuan et al.

(10) Patent No.: US 11,430,372 B2
(45) Date of Patent: Aug. 30, 2022

(54) PIXEL CIRCUIT, DRIVING METHOD THEREOF, AND DISPLAY APPARATUS

(71) Applicant: BOE TECHNOLOGY GROUP CO., LTD., Beijing (CN)

(72) Inventors: Minghua Xuan, Beijing (CN); Han Yue, Beijing (CN); Ning Cong, Beijing (CN); Xiaochuan Chen, Beijing (CN); Lei Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 523 days.

(21) Appl. No.: 16/467,135

(22) PCT Filed: Dec. 12, 2018

(86) PCT No.: PCT/CN2018/120523
§ 371 (c)(1),
(2) Date: Jun. 6, 2019

(87) PCT Pub. No.: WO2020/000917
PCT Pub. Date: Jan. 2, 2020

(65) Prior Publication Data

US 2021/0358387 A1 Nov. 18, 2021

(30) Foreign Application Priority Data

Jun. 27, 2018 (CN) ..... 201810681407.3

(51) Int. Cl.
*G09G 3/32* (2016.01)
*G09G 3/20* (2006.01)

(52) U.S. Cl.
CPC ..... *G09G 3/32* (2013.01); *G09G 3/2074* (2013.01); *G09G 2300/0426* (2013.01);
(Continued)

(58) Field of Classification Search
CPC ..... G09G 3/2074; G09G 3/32; G09G 2300/0426; G09G 2300/0809;
(Continued)

(56) References Cited

U.S. PATENT DOCUMENTS 6,225,750 B1 * 5/2001 Kimura ..... G09G 3/3208 345/84
6,730,966 B2 * 5/2004 Koyama ..... H01L 27/12 257/350
(Continued)

FOREIGN PATENT DOCUMENTS

CN 1277709 A 12/2000
CN 1383536 A 12/2002
(Continued)

OTHER PUBLICATIONS

Office Action dated Apr. 26, 2020, issued in counterpart CN Application No. 201810681407.3, with English Translation. (23 pages).
(Continued)

*Primary Examiner* — Jason M Mandeville
(74) *Attorney, Agent, or Firm* — WHDA, LLP

(57) ABSTRACT

The present disclosure relates to a pixel circuit. The pixel circuit may include at least one light emitting circuit. One of the at least one light emitting circuit may include an input sub-circuit, a latch sub-circuit, and an output sub-circuit. The input sub-circuit may be configured to transmit a signal at a data voltage terminal to the latch sub-circuit. The latch sub-circuit may be configured to generate a control signal in accordance with the signal at the data voltage terminal and store the control signal. The output sub-circuit may be configured to transmit one of a signal at a first voltage terminal and a signal at a second voltage terminal to a light emitting unit under control of the control signal.

14 Claims, 8 Drawing Sheets

(52) U.S. Cl.
CPC ..... *G09G 2300/0809* (2013.01); *G09G 2300/0842* (2013.01); *G09G 2300/0847* (2013.01); *G09G 2300/0857* (2013.01); *G09G 2330/021* (2013.01)

(58) Field of Classification Search
CPC ... G09G 2300/0842; G09G 2300/0847; G09G 2300/0857; G09G 2330/021
USPC ..... 345/694, 76
See application file for complete search history.

(56) References Cited

U.S. PATENT DOCUMENTS

| | | | | |
|---|---|---|---|---|
| 7,554,533 | B2 * | 6/2009 | Benzarti | G09G 3/3233 345/82 |
| 2002/0130828 | A1 | 9/2002 | Yamazaki et al. | |
| 2005/0162353 | A1 | 7/2005 | Kanda | |
| 2006/0164360 | A1 | 7/2006 | Wakabayashi | |
| 2008/0238855 | A1 | 10/2008 | Teranishi et al. | |
| 2009/0091579 | A1 | 4/2009 | Teranishi et al. | |
| 2011/0316897 | A1 | 12/2011 | Teranishi | |
| 2014/0319486 | A1 * | 10/2014 | Hong | G09G 3/32 257/40 |
| 2017/0124968 | A1 | 5/2017 | Shima et al. | |
| 2017/0221435 | A1 | 8/2017 | Shima | |

FOREIGN PATENT DOCUMENTS

| | | | |
|---|---|---|---|
| CN | 101079244 | A | 11/2007 |
| CN | 101261810 | A | 9/2008 |
| CN | 101281737 | A | 10/2008 |
| CN | 101317211 | A | 12/2008 |
| CN | 102298915 | A | 12/2011 |
| CN | 106205453 | A | 12/2016 |
| CN | 107025889 | A | 8/2017 |
| CN | 107403611 | A | 11/2017 |
| JP | 2008-241833 | A | 10/2008 |
| WO | 02/17289 | A1 | 2/2002 |

OTHER PUBLICATIONS

International Search Report dated Apr. 1, 2019, issued in counterpart Application No. PCT/CN2018/120523 (12 pages).

Shimoda T et al, "Technology for active matrix light emitting polymer displays", Electron Devices Meeting, 1999. IEDM Technical Digest. International Washington, DC, USA Dec. 5-8, 1999, Piscataway, NJ, USA, IEEE, US, Dec. 5, 1999 (Dec. 5, 1999), pp. 107-110, XP010372118; Cited in Extended European Search Report dated Apr. 22, 2022. (4 pages).

Extended (Supplementary)European Search Report dated Apr. 22, 2022, issued in counterpart EP Application No. 18887233.7. (22 pages).

* cited by examiner

PIXEL CIRCUIT, DRIVING METHOD THEREOF, AND DISPLAY APPARATUS

CROSS-REFERENCE TO RELATED APPLICATIONS

This application claims benefit of the filing date of Chinese Patent Application No. 201810681407.3 filed on Jul. 27, 2018, the disclosure of which is hereby incorporated in its entirety by reference.

TECHNICAL FIELD

The present disclosure relates to a field of display technology, and particularly, to a pixel circuit, a driving method thereof and a display apparatus.

BACKGROUND

The micro light-emitting diode OILED) technology utilizes an array of high-density micro-scaled LEDs integrated on a substrate to achieve thin film formation, miniaturization and matrixing of the LEDs. The distance between pixels can reach a micrometer scale, and each pixel is addressable and can be individually driven to emit light.

The signals of the LEDs in the uLED apparatus are directly supplied by an integrated circuit (IC). That is, the IC and LED are transferred onto a silicon-based substrate, and the IC provides the signals to each of the LEDs. In order to ensure normal display during the process of driving the LEDs, it is necessary to continuously provide the signals to the LED by the IC, thereby increasing power consumption of the IC.

BRIEF SUMMARY

An example of the present disclosure provides a pixel circuit. The pixel circuit may include at least one light emitting circuit, One of the at least one light emitting circuit may include an input sub-circuit, a latch sub-circuit, and an output sub-circuit. The input sub-circuit may be configured to transmit a signal at a data voltage terminal to the latch sub-circuit. The latch sub-circuit may be configured to generate a control signal in accordance with the signal at the data voltage terminal and store the control signal. The output sub-circuit may be configured to transmit one of a signal at a first voltage terminal and a signal at a second voltage terminal to a light emitting unit under control of the control signal.

The input sub-circuit may be coupled to the data voltage terminal and the latch sub-circuit respectively, and the output sub-circuit may be coupled to the input sub-circuit, the latch sub-circuit, the at least one light emitting unit, the first voltage terminal, and the second voltage terminal respectively.

The input sub-circuit may include a first transistor. A gate of the first transistor may be coupled to a scan signal terminal, a first electrode of the first transistor may be coupled to the data voltage terminal, and a second electrode of the first transistor may be coupled to the latch sub-circuit.

The latch sub-circuit may include a second transistor, a third transistor, a fourth transistor, and a fifth transistor. A gate of the second transistor may be coupled to a first node, a first electrode of the second transistor may be coupled to the first voltage terminal, and a second electrode of the second transistor may be coupled to a second node. A gate of the third transistor may be coupled to the first node, a first electrode of the third transistor may be coupled to the second voltage terminal, and a second electrode of the thud transistor may be coupled to the second node. A gate of the fourth: transistor may be coupled to the second node, a first electrode of the fourth transistor may be coupled to the first voltage terminal, and a second electrode of the fourth transistor may be coupled to the first node. A gate of the fifth transistor may be coupled to the second node, a first electrode of the fifth transistor may be coupled to the second node, and a second electrode of the fifth transistor may be coupled to the first node. The first node may be coupled to the output sub-circuit, and the second node may be coupled to the input sub-circuit and the output sub-circuit.

The second transistor and the fourth transistor may be P-type transistors, and the third transistor and the fifth transistor may be N-type transistors.

The output sub-circuit may include a sixth transistor and a seventh transistor. A gate of the sixth transistor may be coupled to the latch sub-circuit, a first electrode of the sixth transistor may be coupled to the first voltage terminal, and a second electrode of the sixth transistor may be coupled to the at least one light emitting, unit. A gate of the seventh transistor may be coupled to the latch sub-circuit, a first electrode of the seventh transistor may be coupled to the second voltage terminal, and a second electrode of the seventh transistor may be coupled to the at least one light emitting unit. The sixth transistor and the seventh transistor may be a same type of transistor.

In one embodiment, the input sub-circuit includes a first transistor, and a gate of the first transistor is coupled to a scan signal terminal, a first electrode of the first transistor is coupled to the data voltage terminal, and a second electrode of the first transistor is coupled to the latch sub-circuit. The latch sub-circuit includes a second transistor, a third transistor, a fourth transistor, and a fifth transistor, a gate of the second transistor is coupled to a first node, a first electrode of the second transistor is coupled to the first voltage terminal, and a second electrode of the second transistor is coupled to a second node; a gate of the third transistor is coupled to the first node, a first electrode of the third transistor is coupled to the second voltage terminal, and a second electrode of the third transistor is coupled to the second node, a gate of the fourth transistor is coupled to the second node, a first electrode of the fourth transistor is coupled to the first voltage terminal, and a second electrode of the fourth transistor is coupled to the first node, a gate of the fifth transistor is coupled to the second node, a first electrode of the fifth transistor is coupled to the second node, and a second electrode of the fifth transistor is coupled to the first node, and the first node is coupled to the output sub-circuit, and the second node is coupled to the input sub-circuit and the output sub-circuit. The output sub-circuit includes a sixth transistor and a seventh transistor; a gate of the sixth transistor is coupled to the latch sub-circuit, a first electrode of the sixth transistor is coupled to the first voltage terminal, and a second electrode of sixth transistor is coupled to the at least one light emitting unit; and a gate of the seventh transistor is coupled to the latch sub-circuit, a first electrode of the seventh transistor is coupled to the second voltage terminal, and a second electrode of the seventh transistor is coupled to the at least one light emitting unit.

The at least one light emitting circuit may include a plurality of light emitting circuits; and each of the light emitting circuits may be coupled to a different data voltage terminal. At least two of the light emitting circuits may be coupled to a different first voltage terminal respectively, or at least two of the light emitting circuits may be coupled to a different second voltage terminal respectively.

The plurality of light emitting circuits may include a first light emitting circuit and a second light emitting circuit; a light emitting unit coupled to the first light emitting circuit may include a first light emitting unit and a second light emitting unit, and a light emitting unit coupled to the second light emitting circuit may include a third light emitting unit. The first light emitting unit, the second light emitting unit and the third light emitting unit may be capable of emitting a same wavelength of light.

The first light emitting circuit and the second light emitting circuit may be coupled to the same first voltage terminal and the same, second voltage terminal. The first light emitting unit may be coupled to the first voltage terminal and the second light emitting unit may be coupled to the second voltage terminal; the third light emitting unit may be coupled to both the first voltage terminal and the second voltage terminal. The light emitting unit may be a light emitting diode.

Another example of the present disclosure is a display apparatus. The display apparatus may include a plurality of sub-pixels. Each of the plurality of sub-pixels may include the pixel circuit according to one embodiment of the present disclosure. Each of the plurality of sub-pixels may include a plurality of light emitting units.

In one embodiment, the pixel circuit includes a plurality of light emitting circuits, and the plurality of the tight emitting circuits is sequentially arranged along an extending direction of a gate line of the display apparatus.

In one embodiment, the pixel circuit includes a plurality of light emitting circuits, and the plurality of the light emitting circuits are sequentially arranged along an extending direction of a data line of the display apparatus.

Another example of the present disclosure is a driving method for a pixel circuit. The pixel circuit may include at least one light emitting circuit. One of the at least one light emitting circuit may include an input sub-circuit, a latch sub-circuit, and an output sub-circuit. The input sub-circuit may be configured to transmit a signal at a data Voltage terminal to a latch sub-circuit. The latch sub-circuit may be configured to generate a control signal in accordance with the signal at the data voltage terminal and store the control signal. An output sub-circuit may be configured to transmit one of a signal at a first voltage terminal and a signal at a second voltage terminal to a light emitting unit under control of the control signal. The driving method may include providing a signal from the data voltage terminal through the input sub-circuit to the latch sub-circuit, generating and storing a control signal by the latch sub-circuit, and transmitting one of the signal at the first voltage terminal and the signal at the second voltage terminal through a output sub-circuit to a light emitting unit under control of the control signal.

BRIEF DESCRIPTION OF THE DRAWINGS

The subject matter which is regarded as the disclosure is particularly pointed out and distinctly claimed in the claims at the conclusion of the specification. The foregoing and other objects, features, and advantages of the present disclosure are apparent from the following detailed description taken in conjunction with the accompanying drawings in which:

DETAILED DESCRIPTION

Figure 1:
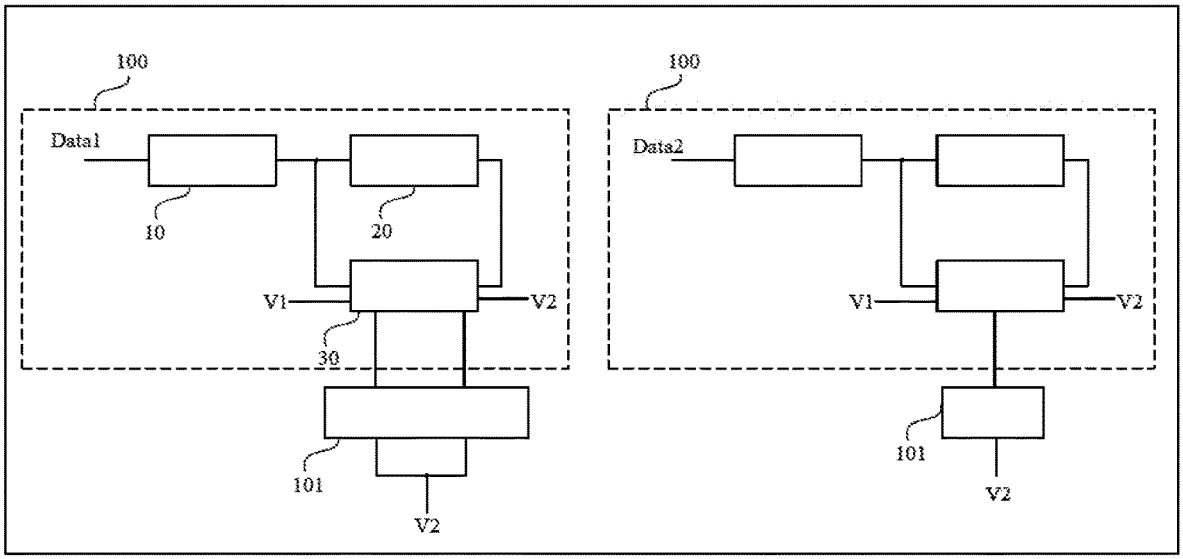
FIG. 1 is a schematic block diagram of a pixel circuit according to one embodiment of the present disclosure.

The present disclosure will be described in further detail with reference to the accompanying drawings and embodiments in order to provide a better understanding by those skilled in the art of the technical solutions of the present disclosure. Throughout the description of the disclosure, reference is made to FIGS. 1-8. When referring to the figures, like structures and elements shown throughout are indicated with like reference numerals.

One embodiment of the present disclosure provides a pixel circuit. As shown in FIG. 1, the pixel circuit includes at least one light emitting circuit 100 such as two light emitting circuits 100 as shown in FIG. 1. The light emitting circuit 100 includes an input sub-circuit 10, a latch sub-circuit 20, an output sub-circuit 30. In one embodiment, as illustrated in FIG. 11, one light emitting unit 101 includes two light emitting units D, and the other light emitting unit 101 includes one light emitting unit D.

In addition, that the light emitting unit 101 may include at least one light emitting unit D indicates that each light emitting unit 101 may include one or a plurality of light emitting units D. The plurality of light emitting units D may be coupled in series, or may be coupled in parallel as shown in FIG. 1, In one embodiment, as shown in FIG. 1, the pixel circuit includes a plurality of light emitting units 100. Each of the light emitting circuits 100 may include a plurality of light emitting units D. In addition, in the case where the pixel circuit includes a plurality of light emitting units D, areas of the light emitting regions of the plurality of light emitting units D may be the same or different.

In one embodiment, as shown in FIG. 1, the input sub-circuit 10 is coupled to the latch sub-circuit 20 and a data voltage terminal DATA respectively for transmitting the signal at the data voltage terminal DATA to the latch sub-circuit 20.

The latch sub-circuit 20 may be configured to generate and store a control signal based on the signal inputted at the data voltage terminal DATA. In one embodiment; the latch sub-circuit 20 may be a latch.

In one embodiment, the output sub-circuit 30 is coupled to the input sub-circuit 10, the latch sub-circuit 20, the light emitting units D, a first voltage terminal V1, and a second voltage terminal V2 for outputting the signal of the first voltage terminal V1 or the signal of the second voltage terminal V2 based on the control si final.

Here, in the following embodiments of the present disclosure, the signal at the 2 first voltage terminal V1 is a high-level signal in comparison with the signal at the second voltage terminal V2. In one embodiment, the signal at the first voltage terminal V1 is a high level voltage (VDD), and the signal at the second voltage terminal V2 is a low level voltage (VSS).

In one embodiment, the at least one light emitting unit D is also coupled to the second voltage terminal V2. The at least one light emitting unit D is controlled to be at a light state under control of the signal of the first voltage terminal V outputted from the output sub-circuit 30, and to be at a dark state under control of the signal of the second voltage terminal V2 outputted from the output sub-circuit 30.

In one embodiment, as shown in FIG. 1, the pixel circuit includes a plurality of light emitting circuits 100, Different light emitting circuits 100 may be couplet to different data voltage terminals DATA respectively. In other words, the light emitting circuits 100 can transmit signals at different data voltage terminals DATA so that the plurality of light emitting circuits 100 can be driven asynchronously. As a result, the light and dark states of each of the respective light emitting units D located in the plurality of light emitting circuits 100 are not synchronized so that multi-gray scale display can be realized.

One embodiment of the present disclosure provides a pixel circuit. The pixel circuit includes a latch sub-circuit 20 that generates a control signal in response to the signal of the input sub-circuit 10 to control the at least one light emitting unit D to be at a light state or a dark state and stores the control signal in order to maintain the current state of the at least one light emitting unit D. In this way, during the display process, the integrated circuit (IC) inputs a signal to the data voltage terminal DATA of the pixel circuit to display an image. When there is no change to the displayed image, IC does not need to continuously input a signal to the data voltage terminal DATA of the pixel circuit. Instead, the latch sub-circuit 20 maintains the output of the control signal to maintain the currently displayed image, thereby greatly reducing the power consumption of the IC.

In some embodiments, the pixel circuit includes a plurality of light emitting circuits 100. The luminance of each of the light emitting circuits 100 is different when the light emitting units D are in the light state.

That is, taking the pixel circuit shown in FIG. 1 as an example, from the perspective of the figure, when the light emitting units D coupled to the light emitting circuit 100 (including two light emitting units D) as shown in the left and the light emitting unit D coupled to the light emitting circuit 100 (including one light emitting unit D) as shown in the right are at the "light" state, the luminance of the light emitting circuit 100 on the left is different from that of the light emitting circuit 100 on the right.

In one embodiment, area of the light emitting region of each of the light emitting units D in the pixel circuit is the same, but the number of the light emitting units D in each of the light emitting circuits 100 is different. In one embodiment, the number of the light emitting units D in each of the light emitting circuits 100 is the same, but the area of the light emitting region of each of the light emitting units D is not the same. Alternatively, other ways may be used to achieve different luminance of each of the light emitting circuits 100.

In one embodiment, the pixel circuit includes a first light emitting circuit, a second light emitting circuit, and a third light emitting circuit, and the three light emitting circuits have different luminance. As such, the pixel circuit can display eight gray scales. Therefore, in the embodiments of the present disclosure, by making the luminance of each of the light emitting circuits 100 to be different, a maximum number of gray scales can be displayed under the premise of the same Timber of light emitting circuits 100.

Figure 2:
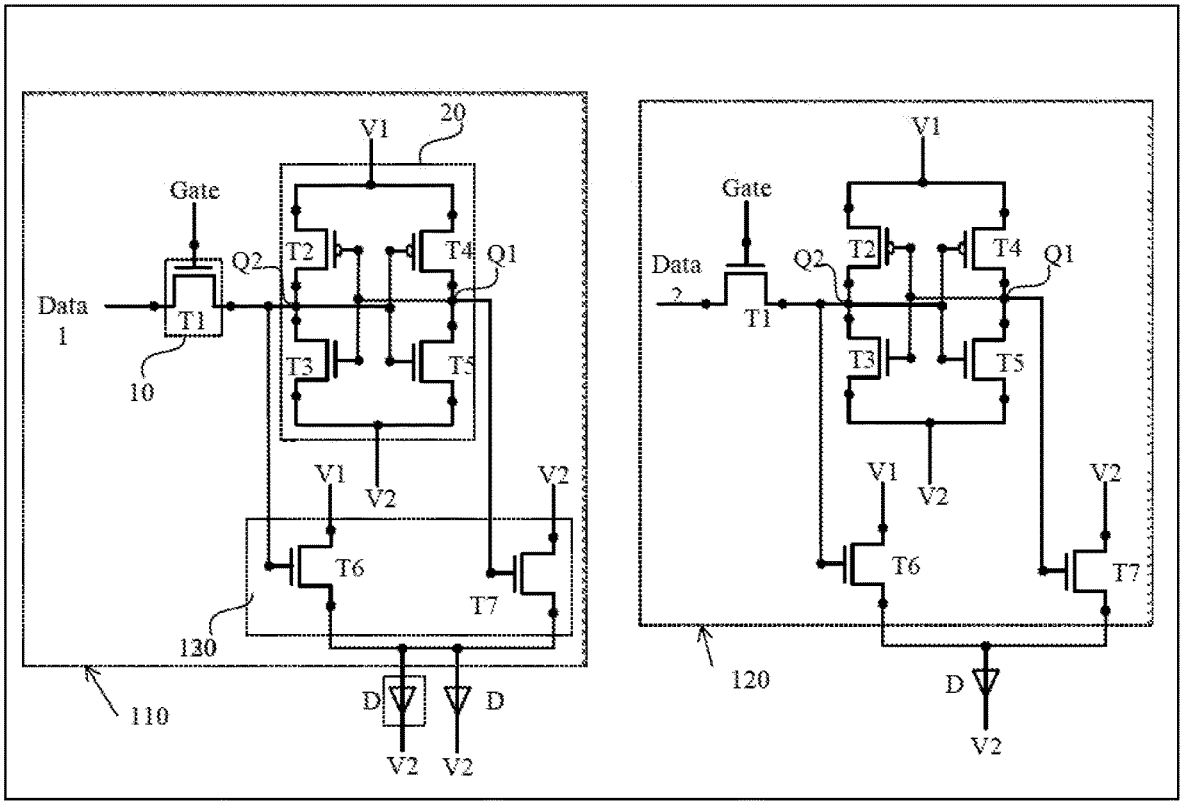
FIG. 2 is a schematic structural diagram of a pixel nit according to one embodiment of the present disclosure.

In some embodiments, as shown in FIG. 2, the pixel circuit includes a first light emitting circuit 110 and a second light emitting circuit 120.

In some embodiments, as shown in FIG. 2, the input sub-circuit 10 includes a first transistor A gate of the first transistor is coupled to a scan signal terminal GATE. A first electrode of the first transistor is coupled to the data voltage terminal DATA. A second electrode of the first transistor T1 is coupled to the latch sub-circuit 20.

In some embodiments, as shown in FIG. 2, the input sub-circuit 10 includes a first transistor T1. A gate of the first transistor is coupled to a scan signal terminal GATE A first electrode of the first transistor is coupled to the data voltage terminal DATA. A second electrode of the first transistor T1 is coupled to a second node Q2.

It should be noted that the input sub-circuit 10 may further include a plurality of switching transistors connected in parallel with the first transistor T1. The above is only an example of the input sub-circuit 10. Other structures having the same function as the input sub-circuit 10 will not be further described herein, but all should belong to the protection scope of the present disclosure.

In some embodiments, in order to simplify the structure of the pixel circuit, as shown in FIG. 2, the latch sub-circuit 20 includes a second transistor T2, a third transistor T3, a fourth transistor T4, and a fifth transistor T5. The second transistor T2 and the fourth transistor T4 are P-type transistors. The third transistor T3 and the fifth transistor T5 are N-type transistors.

In one embodiment, a gate of the second transistor T2 is coupled to the first node Q1. A first electrode of the second transistor T2 is coupled to the first voltage terminal V1. A second electrode of the second transistor T2 is coupled to the second node Q2.

In one embodiment, a gate of the third transistor T3 is coupled to the first node Q1. A first electrode of the third transistor T3 is coupled to the second voltage terminal V2. A second electrode of the third transistor T3 is coupled to the second node Q2.

In one embodiment, a gate of the fourth transistor 14 is coupled to the second node Q2. A first electrode of the fourth transistor T4 is coupled to the first voltage terminal V1. A second electrode of the fourth transistor T4 is coupled to the first node Q1.

In one embodiment, a gate of the fifth transistor is coupled to the second node A first electrode of the fifth transistor T5 is coupled to the second voltage V2. A second electrode of the fifth transistor T5 is coupled to the first node Q1.

In one embodiment, the first node is coupled to the output sub-circuit 30. The second node Q2 is coupled to the input sub-circuit 10 and the output sub-circuit 30. In other words, the second node Q2 serves both as an input port of the latch sub-circuit 20 and as an output port of the latch sub-circuit 20.

In some embodiments, as shown in FIG. 2, the output sub-circuit 30 includes a sixth transistor T6 and a seventh transistor T7. The sixth transistor T6 and the seventh transistor T7 are transistors of the same type.

In one embodiment, a gate of the sixth transistor T6 is coupled to the latch sub-circuit 20. A first electrode of the sixth transistor T6 is coupled to the first voltage V1. A second electrode of the sixth transistor T6 is coupled to the at least one light emitting unit D.

In one embodiment, as shown in FIG. 2, the gate of the sixth transistor is coupled to the second node Q2, the first electrode of the sixth transistor T6 is coupled to the first voltage V1. The second electrode of the sixth transistor T6 is coupled to the at least one light emitting unit D.

In one embodiment, a gate of the seventh transistor T7 is coupled to the latch sub-circuit 20. A first electrode of the seventh transistor T7 is coupled to the second voltage terminal V2. A second electrode of the seventh transistor T7 is coupled to the at least one light emitting unit D.

In one embodiment, as shown in FIG. 2, the gate of the seventh transistor T7 is coupled to the first node Q1. The first electrode of the seventh transistor T7 is coupled to the second voltage terminal V2. The second electrode of the seventh transistor T7 is coupled to the at least one light emitting unit D.

It should be noted that the output sub-circuit 30 may include a plurality of switching transistor coupled in parallel with the sixth transistor T6 or a plurality of switching transistor coupled in parallel with the seventh transistor T7. The above is only an example of the output sub-circuit 30. Other structures having the same function as the output sub-circuit 30 will not be further described herein, but all should belong to the protection scope of the present disclosure.

In one embodiment, as can be seen from FIG. 2, the plurality of light emitting circuits 100 included in the pixel circuit are coupled to different data voltage terminals DATA, but are coupled to the same scan signal terminal GATE.

Based on the above description of the sub-circuits, some embodiments of the driving method of the above mentioned pixel circuit will be described in detail below.

It should be noted that, first, in the embodiments of the present disclosure, if the respective transistors in the pixel circuit are not clearly defined, the transistors may be an N-type transistor or a P-type transistor, in one embodiment, the first transistor T1, the sixth transistor T6, and the seventh transistor T7 are N-type transistors. The following embodiments of the present disclosure are all described by taking the above transistors as N-type transistors as example.

Here, the first electrode of the above-mentioned transistor may be the drain and the second electrode may be the source. Alternatively, the first electrode may be the source, and the second electrode may be the drain, which are not limited in the embodiments of the present disclosure.

Further, based on the various electrically conductive manner of the transistor, the transistors in the above pixel circuit can be classified as enhancement transistors and depletion transistors. The embodiment of the present disclosure is not limited to these.

Second, in the embodiments of the present disclosure, that a high-level VDD is inputted to the first voltage terminal V1 and a low-level VSS is inputted into the second voltage terminal V2 is taken as an example. The second voltage terminal can also be grounded. The high and low values only indicate the relative magnitude relationship between the input voltages.

Figure 3:
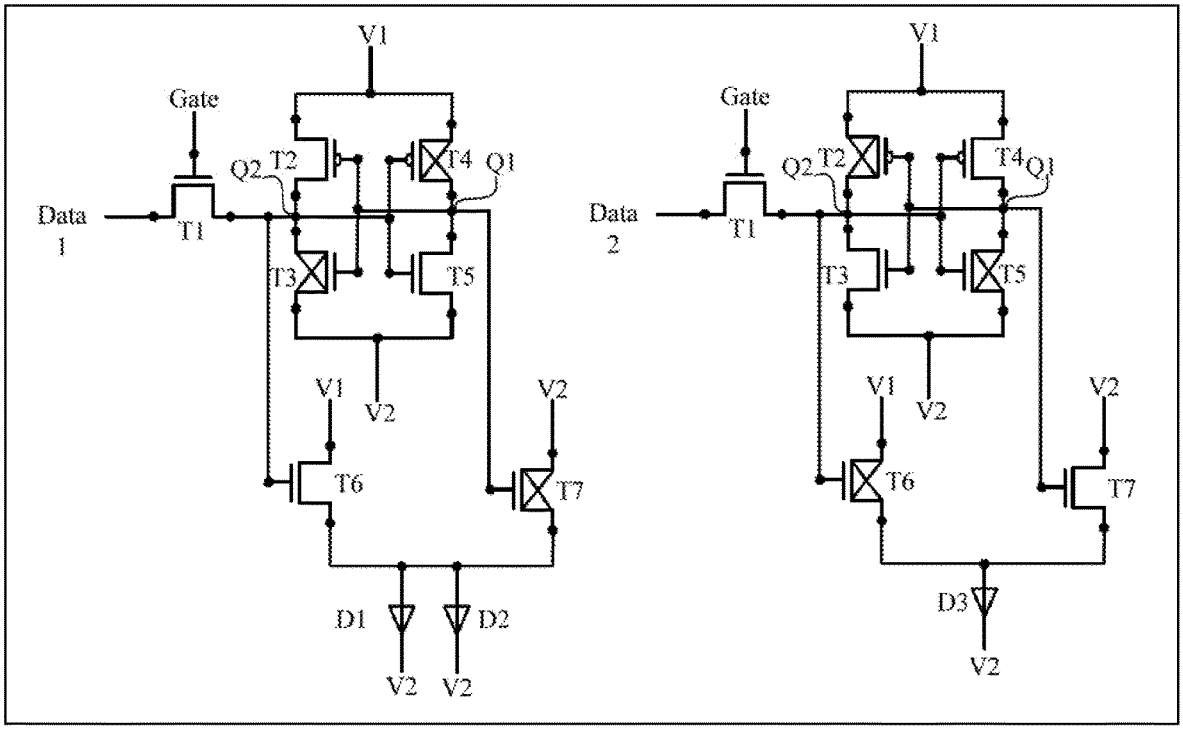
FIG. 3 is a schematic diagram of a driving process of a pixel circuit according to one embodiment of the present disclosure.

In one embodiment, as shown in FIG. 3, in the case where it is required to control the first light emitting unit D1 and the second light emitting unit D2 to be in a tight state, and the third light emitting unit D3 to be in a dark state:

In the light emitting circuit on the left, the scan signal terminal GATE is inputted a high level "on" signal, and the first data voltage terminal DATA 1 is inputted a high level signal. The fourth transistor T4 is controlled to be turned off, and at the same time, the fifth transistor T5 is controlled to be turned on. As such, the low level signal of the second voltage terminal V2 is transmitted to the first node Q1, which controls the third transistor T3 to be turned off, and, at the same time, controls the second transistor T2 to be turned on. As a result, the high level signal of the first voltage terminal V1 is transmitted to the second node Q2, The seventh transistor T7 is turned off under the control of the low level signal of the first node Q1. The sixth transistor T6 is turned on under the control of the high level signal of the second node Q2 and transmits the high level signal of the first voltage terminal V1 to the first light emitting unit D1 and the second light emitting unit D2. Accordingly, the first light emitting unit D1 and the second light emitting unit D2 are driven to be at a light state, Here, the transistors in the off state are indicated by "X."

At the same time in the light emitting circuit on the right, the scan signal terminal GATE is inputted a high level "on" signal, and the data voltage terminal is inputted a low level signal. The fifth transistor is controlled to be turned off and the fourth transistor to be turned on. As such, the high level signal of the first voltage terminal V1 is transmitted to the first node Q1 which controls the second transistor to be turned off and the third transistor to be turned on. As a result, the low level signal of the second voltage terminal V2 is transmitted to the second node Q2. The sixth transistor T6 is turned off under the control of the second node Q2. The seventh transistor T7 is turned on under the control of the high level signal of the first node, and transmits the low level signal of the second voltage terminal to the third light emitting unit D3. Accordingly, the third light emitting unit D3 is driven to be at a dark state.

Figure 4:
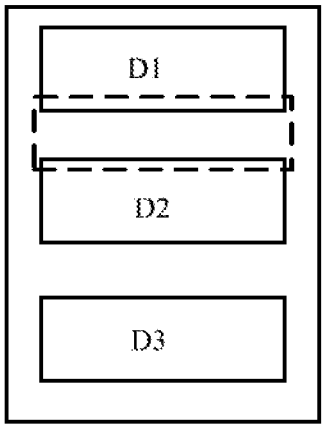
FIG. 4 is a schematic diagram alight emitting units in a pixel circuit according to one embodiment of the present disclosure.
Figure 5:
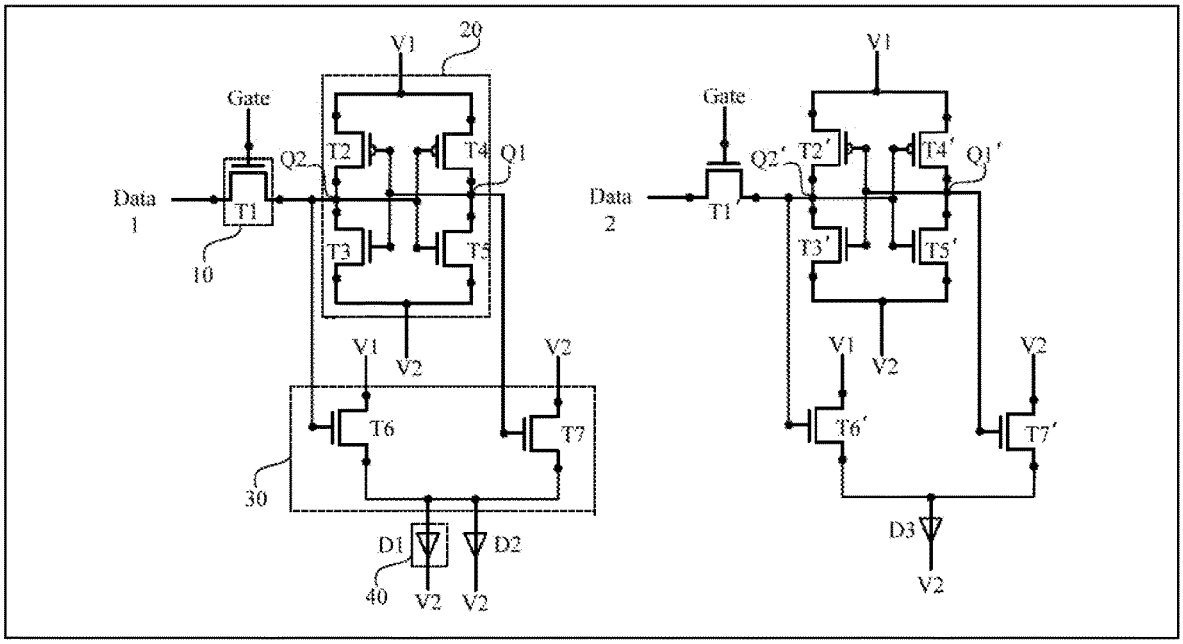
FIG. 5 is a schematic structural diagram of a pixel circuit according to one embodiment of the present disclosure.

Based on this, in some embodiments, as shown in FIGS. 4 and 5, the pixel circuit includes two light emitting circuits 100. One of the light emitting circuits 100 coupled to two light emitting units D (the first light emitting unit D1 and the second light emitting unit D2), and the other light emitting circuit 100 coupled to one light emitting unit D (the third light emitting unit D3).

In some embodiments, the two light emitting units D in the light emitting circuit 100 may be coupled in series or in parallel. The light emitting unit D may be, for example, a light emitting diode. The light emitting units D of a sub-pixel can be arranged as shown in FIG. 4. The box with the dotted line indicates a connecting member of the first light emitting unit D1 and the second light emitting unit D2. The first light emitting unit D1 and the second light second emitting unit D2 may be coupled in parallel through the connecting member. It can be understood that the connecting member can connect the two light emitting units D1 and D2 in parallel by using a bridge or a through hole.

Based on this, in some embodiments, the plurality of light emitting circuits 100 in the same pixel circuit emits light having the same wavelength. That is, regardless of the number of light emitting circuits included in the pixel circuit, the light emitting circuits 100 located in the same pixel circuit emits light of the same wavelength. That is, the light emitting units D located in the same pixel circuit emits light of the same color. Each of the pixel circuits emits a monochromatic light or emits white light. In one embodiment, the light emitting unit D emitting white light can be formed by a combination of a blue light emitting diode and a phosphor.

For the convenience of explanation, the transistors in the two light emitting circuits 100 as shown in FIG. 5 are distinguished by adding "'" after the label. For example, the first node in the left light emitting circuit 100 is Q1, and the first node in the right light emitting circuit 100 is Q1'.

Based on the above description, the driving state of the pixel circuit can be divided into the following:

In one embodiment, the scan signal terminal GATE is inputted a high level "on" signal, the first data voltage terminal Data1 is inputted a high level signal, the first node Q1 stores a digital signal "1" (high level), and the second node Q2 stores a digital signal "0" (low level). The sixth transistor is controlled to be turned on, and the first light emitting unit D1 and the second light emitting unit D2 emit light. The second data voltage terminal Data2 is inputted a high level signal, the first node Q1 stores a digital signal "1," the second node Q2' stores a digital signal "0," the sixth transistor T6' is controlled to be turned on, and the third light emitting unit D3 emits light. This state is defined as 13 grayscale.

In one embodiment, the scan digital terminal GATE is inputted a high level "on" signal, the first data voltage terminal Data1 is inputted a high level signal, the first node Q1 stores a digital signal "1," and the second node Q2 stores a digital signal "0." The sixth transistor T6 is controlled to be turned on, and the first light emitting unit D1 and the second light emitting unit D2 emit light. The second data voltage terminal Data2 is inputted a low level signal, the first node Q1' stores the digital signal "0," and the second node Q2' store a digital signal "1." The seventh transistor T7' is controlled to be turned on, and the third light emitting unit D3 does not emit light. This state is defined as L2 grayscale.

In one embodiment, the scan digital terminal GATE is inputted a high level "on" signal, the first data voltage terminal Data1 is inputted a low level signal, the first node Q1 stores a digital signal "0," and the second node Q2 stores a digital signal "1," The seventh transistor T7 is controlled to be turned on, and the first light emitting unit D1 and the second light emitting unit D2 do not emit light. The second node Q2' stores a digital signal "0" and controls the sixth transistor T6' to be turned on. The third light emitting unit D3 emits light. The state is defined as L1 grayscale.

In one embodiment, the scan digital terminal GATE is inputted a high level "on" signal, the first data voltage terminal Data1 is inputted a low level signal, the first node Q1 stores a digital signal "0," and the second node Q2 stores a digital signal "1," The seventh transistor T7 is controlled to be turned on, and the first light emitting unit D1 and the second light emitting unit D2 do not emit light. The second data voltage terminal Data2 is inputted a low level signal, the first node Q1' stores a digital signal "0," the second node Q2' stores a digital signal "1" and controls the seventh transistor T7' to be turned on. The third light emitting unit D3 does not emit a light. This state is defined as L0 grayscale.

Therefore, the pixel circuit can realize four grayscales of L3-L0. When the pixel circuit is applied to a combination of red sub-pixel, green sub-pixel, and blue sub-pixel, a 4×4×4=64 grayscales can be realized, which is enough for everyday display devices such as watches. Further, when the image being displayed is unchanged, the 1C does not need to provide signals to the data voltage terminal DATA and the scan signal terminal GATE. Therefore, the power consumption of the IC can be greatly reduced.

Here, when a higher grayscale is to be displayed, it can be realized by increasing the number of the light emitting circuits 100 in the pixel circuit Here only using the pixel circuit including two light emitting circuits 100 for illustration.

Everyday display panels and watches today, in consideration of the leakage current, supports frequencies of 60 Hz and 30 Hz, and it is difficult to support lower frequencies. However, the present disclosure adopts a digital circuit control mode and uses a latch sub-circuit 20 to store signal "1" and "0" to control whether the light emitting diode emits light or does not emit light. Therefore, frequencies below 30 Hz or even can be supported.

One embodiment of the present disclosure provides a driving method of the above-mentioned pixel circuit. The driving method includes the following:

The data voltage terminal DATA provides a signal to the latch sub-circuit 20 through the input sub-circuit 10, causes the latch sub-circuit 20 to generate a control signal. The latch sub-circuit 20 transmits the control signal to the output sub-circuit and stores the control signal.

Under the control of the control signal, the output sub-circuit 30 outputs a signal at the first voltage terminal V1 or a signal at the second voltage terminal V2 to the at least one light emitting unit D.

Here, the output sub-circuit 30 outputs the signal at the first voltage terminal V1 or the signal at the second voltage terminal V2 under the control of the control signal. In other words, the output sub-circuit 30 outputs a different signal depending on the control signal. Therefore, the control signal generated by the latch sub-circuit 20 includes a first control signal and a second control signal.

Under the control of the first control signal, the output sub-circuit 30 outputs the signal of the first voltage terminal V1 to control the at least one light emitting unit to be at a light state. Under the second control signal, the output sub-circuit 30 outputs the signal of the second voltage terminal V2 to control the at least one light emitting unit to be at a dark state.

The beneficial effects of the driving method of the pixel circuit provided by the embodiments of the present disclosure are the same as those of the pixel circuit and are not described herein again.

In some embodiments, as shown in FIG. 2, the input sub-circuit 10 includes a first transistor T1, The latch sub-circuit 20 includes a second transistor 12, a third transistor T3, a fourth transistor T4 and a fifth transistor T5. The output sub-circuit 30 includes a sixth transistor T6 and a seventh transistor T7.

The driving method of the pixel circuit includes the following: under the control of the scan signal terminal Gate, the first transistor T1 transmits the first signal (high level signal) of the data voltage terminal to the second node Q2. Under the control of the second node Q2, the fifth transistor T5 transmits the signal of the second voltage terminal V2 to the first node, and the fourth transistor T4 is turned off. The seventh transistor T7 and the third transistor T3 are turned off under the control of the first node Q1, and the second transistor T2 transmits the first voltage terminal V1 signal to the second node Q2. Under the control of the second node Q2, the sixth transistor T6 transits the signal of the first voltage terminal V1 to the at least one light emitting unit D to control the at least one light emitting unit D to be in a light state.

Under the control of the scan terminal GATE, the first transistor T1 transits the signal (low level signal) of the data voltage terminal DATA to the second node Q2. Under the control of the second node Q2, the fourth transistor T4 transmits the signal of the first voltage terminal V1 to the first node Q1, and the fifth transistor T5 is turned off. Under the control of the first node Q1, the seventh transistor T7 transmits the signal of the second voltage terminal V2 to the at lease one light emitting unit D to control the at least one light emitting unit D to be in a dark state, the second transistor T2 is turned off, and the third transistor T3 transmits the second voltage terminal V2 signal to the second node Q2. Under the control of the second node Q2, the sixth transistor T6 is turned off.

Here, the first signal inputted at the data voltage terminal DATA is a high level signal relative to the second signal inputted at the data voltage terminal DATA.

One embodiment of the present disclosure also provides a display apparatus. The display apparatus includes a plurality of sub-pixels. Each of the sub-pixels includes the above, pixel circuit.

Here, the above display apparatus may be a display panel, or an apparatus including a display panel and may specifically be a projector, components with any display function such as monitors, digital photo frames, mobile phones, tablets, navigators, and watches, etc.

One embodiment of the present disclosure provides a display apparatus. The pixel circuit of the display apparatus includes a latch sub-circuit 20. The latch sub-circuit 20 transmits the control signal generated in accordance with the signal of the input sub-circuit 10 to control the at least one light emitting unit D to be either in a light state or a dark state, and the control signal is stored in the latch sub-circuit 20 in order to maintain the current state of the at least one light emitting unit D. In this way, during the display process, the IC inputs a signal to the data voltage terminal to display the to-be-displayed image. When the displayed image does not change, the IC does not need to continuously input a signal to the data voltage terminal. The latch sub-circuit 20 maintains the output of the control signal to maintain the currently displayed image, thereby greatly reducing the power consumption of the IC.

On the basis of this, the pixel circuit of the display apparatus provided by some, embodiments of the present disclosure can be directly formed on the glass substrate, and the process thereof is mature and the cost is low.

The display apparatus provided by the embodiments of the present disclosure includes the above pixel circuit, and the beneficial effects are the same as those of the above pixel circuit, and therefore, are not described herein again.

Figure 6:
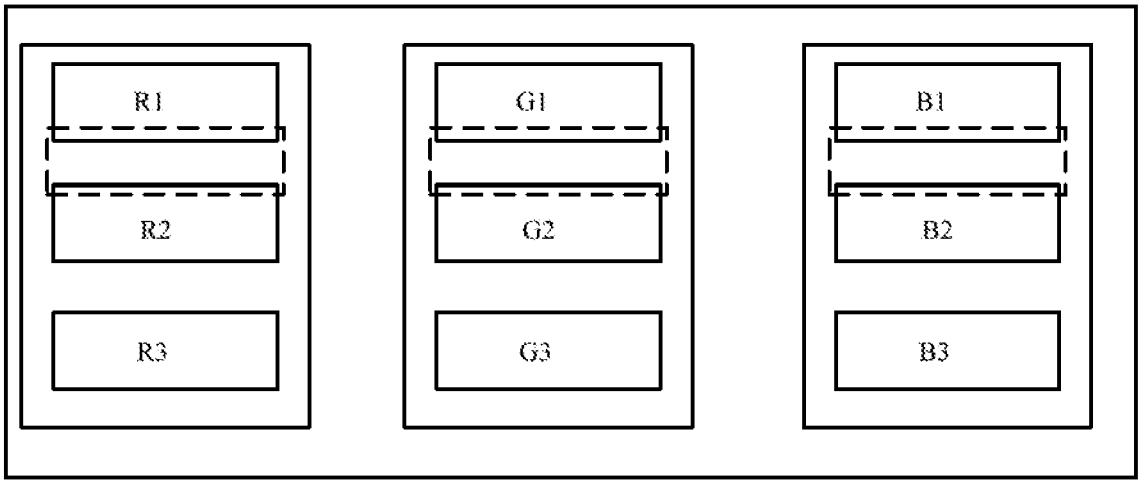
FIG. 6 is a schematic diagram of sub-pixels in a display apparatus according to one embodiment of the present disclosure.

In some embodiments, as shown in FIG. 6, each of the sub-pixels includes a plurality of light emitting units D, and area of the light emitting region of each of the light emitting units of the same sub-pixel is the same.

As shown in FIG. 6, three sub-pixels are illustrated. Each of the sub-pixels includes three light emitting units D, and the area of the light emitting region of each of the three light emitting units D it the same sub-pixel is the same. However, the areas of the light emitting regions of the light emitting units D of different sub-pixels are not the same. Of course, the number alight emitting units D in each of the sub-pixel pixels can be different.

In this way, since the size of each of the light emitting units D is the same, the process of making the light emitting units D can be simplified.

Figure 7:
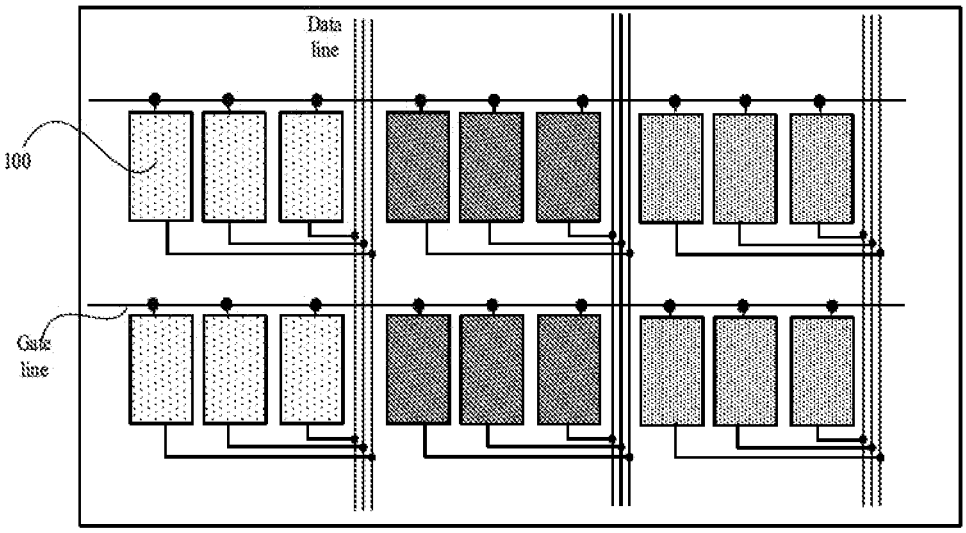
FIG. 7 is a schematic diagram of an arrangement of light emitting circuits in display apparatus according to one embodiment of the present disclosure.

In some embodiments, as shown in FIG. 7, the pixel circuit includes a plurality of light emitting circuits 100. The plurality of light emitting circuits 100 are sequentially arranged along extending direction of the gate lines of the display apparatus.

During the process of display, the plurality alight emitting circuits 100 in one sub-pixel need to be simultaneously driven. Therefore, sequentially arranging the plurality of the light emitting circuits 100 along the extending direction of the gate lines of the display apparatus can reduce the number of gate lines. A single gate line can drive all the light emitting circuits 100 in a row of sub-pixels.

Here, the light emitting circuits 100 are sequentially arranged along the extending direction of the gale lines of the display apparatus, and the light emitting units D in the light emitting circuit 100 can also be sequentially arranged along the extending direction of the gate lines. As such, the light emitting units D in the entire display apparatus are arranged in an array.

Figure 8:
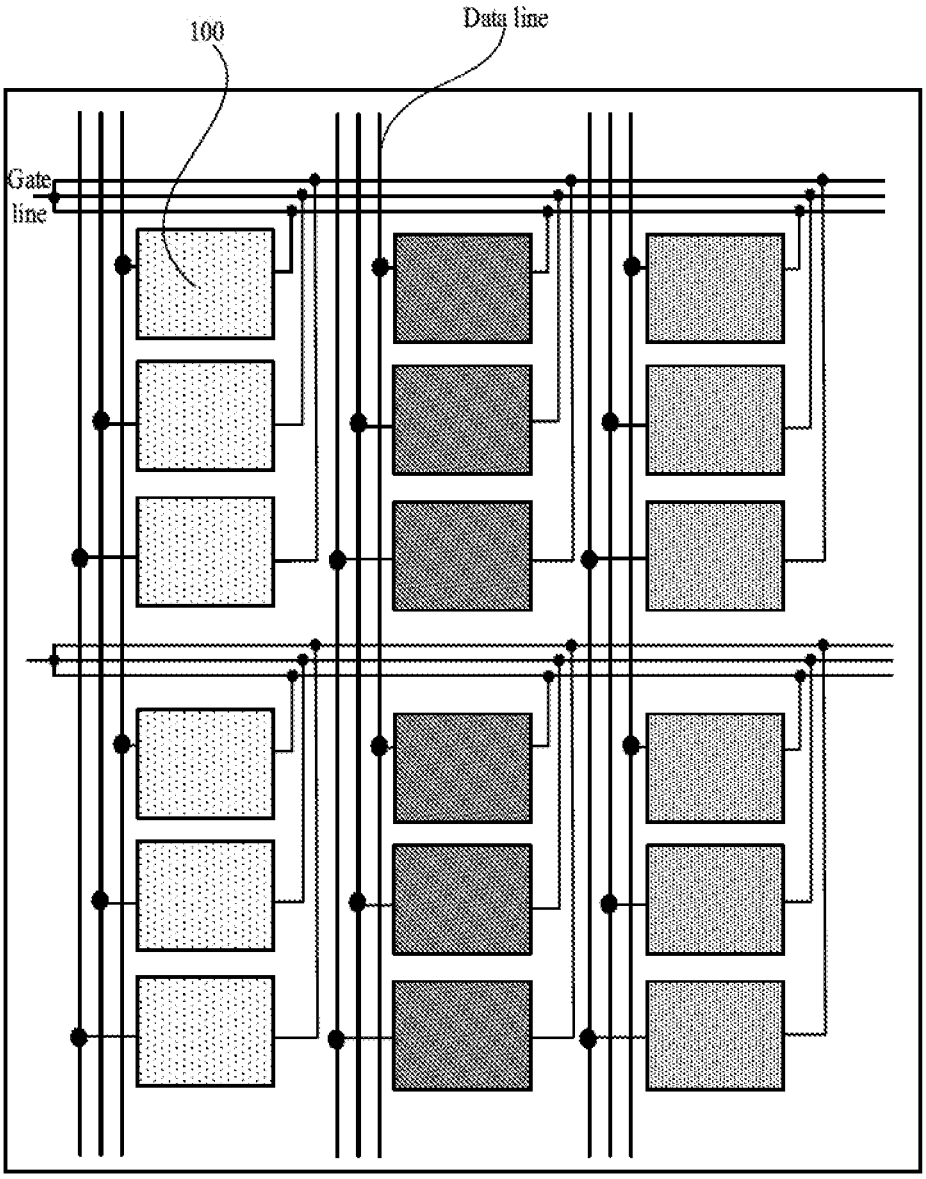
FIG. 8 is a schematic diagram of an arrangement of light emitting circuits in a display apparatus according to one embodiment of the present disclosure.

In some embodiments, as shown in FIG. 8, the pixel circuit includes a plurality of light emitting circuits 100. The plurality alight emitting circuits 100 are sequentially arranged along the extending direction of the data lines of the display apparatus.

In addition, since the plurality of light emitting circuits 100 in one sub-pixel need to be driven at the same time during the process of displaying, each of the light emitting circuits 100 needs to input a gate driven signal. A gate line can drive a group alight emitting circuits 100. The three gate lines for the same sub-pixel can be coupled to a same signal terminal, or can be respectively coupled to a signal terminal. Of course, it is also possible to reduce the number of gate lines by rationally planning the path of the gate lines.

Here, the light emitting circuits 100 are sequentially arranged along the extending direction of the data lines of the display device. The light emitting units D in the light emitting circuit 100 can also be sequentially arranged along the extending direction of the data lines. As such, the light emitting units D in the entire display device are arranged in an array.

In this way, the pixel circuits in the same row are simultaneously driven by one gate line, and the pixel circuits in the same column are driven by one data line in a time division manner which can reduce the IC power consumption and at the same time, greatly reduce the number of IC. This is suitable for display apparatuses that perform long display time such as a watch.

The principle and the embodiment of the present disclosures are set forth in the specification. The description of the embodiments of the present disclosure is only used to help understand the method of the present disclosure and the core idea thereof. Meanwhile, for a person of ordinary skill in the art, the disclosure relates to the scope of the disclosure, and the technical scheme is not limited to the specific combination of the technical features, and also should covered other technical schemes which are formed by combining the technical features or the equivalent features of the technical features without departing from the inventive concept. For example, technical scheme may be obtained by replacing the features described above as disclosed in this disclosure (but not limited to) with similar features.

REFERENCE NUMBERS IN THE FIGURES lighting circuit 100; input sub-circuit 10; latch sub-circuit 20; output sub-circuit 30; light emitting unit D; data voltage terminal DATA; scanning signal terminal GATE; first voltage terminal V1; second voltage terminal V2; first node Q1; second node Q2; first transistor T1; second transistor T2; third transistor 13; fourth transistor T4; fifth transistor T5; sixth transistor T6; seventh transistor T7.

What is claimed is:

1. A pixel circuit, comprising:

a plurality of light emitting circuits, wherein each of the plurality of light emitting circuits comprises:

an input sub-circuit, configured to transmit a signal at a data voltage terminal to a latch sub-circuit;

the latch sub-circuit, configured to generate a control signal in accordance with the signal at the data voltage terminal and store the control signal; and an output sub-circuit, configured to transmit one of a signal at a first voltage terminal and a signal at a second voltage terminal to a light emitting unit under control of the control signal;

wherein the first voltage terminal and the second voltage terminal provide a fixed high level voltage and a fixed low level voltage to the latch sub-circuit;

the plurality of light emitting circuits comprise a first light emitting circuit and a second light emitting circuit, and the first light emitting circuit and the second light emitting circuit are configured to control a sub-pixel;

the sub-pixel comprises a first light emitting unit, a second light emitting unit, and a third light emitting unit;

the first light emitting unit and the second light emitting unit are coupled in parallel to the first light emitting circuit;

the third light emitting unit is coupled to the second light emitting circuit;

the first light emitting unit, the second light emitting unit and the third light emitting unit emit a same wavelength of light;

the first light emitting circuit and the second light emitting circuit are configured to provide voltages from the first voltage terminal and the second voltage terminal to control the sub-pixel in four grayscale states.

2. The pixel circuit according to claim 1, wherein the input sub-circuit is coupled to the data voltage terminal and the latch sub-circuit respectively, and the output sub-circuit is coupled to the input sub-circuit, the latch sub-circuit, the at least one light emitting unit, the first voltage terminal, and the second voltage terminal respectively.

3. The pixel circuit according to claim 1, wherein the input sub-circuit comprises a first transistor, and wherein a gate of the first transistor is coupled to a scan signal terminal, a first electrode of the first transistor is coupled to the data voltage terminal, and a second electrode of the first transistor is coupled to the latch sub-circuit.

4. The pixel circuit according to claim 1, wherein the latch sub-circuit comprises a second transistor, a third transistor, a fourth transistor, and a fifth transistor, wherein a gate of the second transistor is coupled to a first node, a first electrode of the second transistor is coupled to the first voltage terminal, and a second electrode of the second transistor is coupled to a second node;

a gate of the third transistor is coupled to the first node, a first electrode of the third transistor is coupled to the second voltage terminal, and a second electrode of the third transistor is coupled to the second node, a gate of the fourth transistor is coupled to the second node, a first electrode of the fourth transistor is coupled to the first voltage terminal, and a second electrode of the fourth transistor is coupled to the first node, a gate of the fifth transistor is coupled to the second node, a first electrode of the fifth transistor is coupled to the second node, and a second electrode of the fifth transistor is coupled to the first node, and the first node is coupled to the output sub-circuit, and the second node is coupled to the input sub-circuit and the output sub-circuit.

5. The pixel circuit according to claim 4, wherein the second transistor and the fourth transistor are P-type transistors, and the third transistor and the fifth transistor are N-type transistors.

6. The pixel circuit according to claim 1, wherein the output sub-circuit comprises a sixth transistor and a seventh transistor;

wherein a gate of the sixth transistor is coupled to the latch sub-circuit, a first electrode of the sixth transistor is coupled to the first voltage terminal, and a second electrode of the sixth transistor is coupled to the at least one light emitting unit; and a gate of the seventh transistor is coupled to the latch sub-circuit, a first electrode of the seventh transistor is coupled to the second voltage terminal, and a second electrode of the seventh transistor is coupled to the at least one light emitting unit.

7. The pixel circuit according to claim 6, where the sixth transistor and the seventh transistor are a same type of transistor.

8. The pixel circuit according to claim 1, wherein:

the input sub-circuit comprises a first transistor, and a gate of the first transistor is coupled to a scan signal terminal, a first electrode of the first transistor is coupled to the data voltage terminal, and a second electrode of the first transistor is coupled to the latch sub-circuit;

the latch sub-circuit comprises a second transistor, a third transistor, a fourth transistor, and a fifth transistor, a gate of the second transistor is coupled to a first node, a first electrode of the second transistor is coupled to the first voltage terminal, and a second electrode of the second transistor is coupled to a second node; a gate of the third transistor is coupled to the first node, a first electrode of the third transistor is coupled to the second voltage terminal, and a second electrode of the third transistor is coupled to the second node, a gate of the fourth transistor is coupled to the second node, a first electrode of the fourth transistor is coupled to the first voltage terminal, and a second electrode of the fourth transistor is coupled to the first node, a gate of the fifth transistor is coupled to the second node, a first electrode of the fifth transistor is coupled to the second node, and a second electrode of the fifth transistor is coupled to the first node, and the first node is coupled to the output sub-circuit, and the second node is coupled to the input sub-circuit and the output sub-circuit;

the output sub-circuit comprises a sixth transistor and a seventh transistor; a gate of the sixth transistor is coupled to the latch sub-circuit, a first electrode of the sixth transistor is coupled to the first voltage terminal, and a second electrode of the sixth transistor is coupled to the at least one light emitting unit; and a gate of the seventh transistor is coupled to the latch sub-circuit, a first electrode of the seventh transistor is coupled to the second voltage terminal, and a second electrode of the seventh transistor is coupled to the at least one light emitting unit.

9. The pixel circuit according to claim 1, wherein the light emitting unit is a light emitting diode.

10. A display apparatus, comprising:

a plurality of sub-pixels, wherein each of the plurality of sub-pixels comprises the pixel circuit of claim 1.

11. The display apparatus according to claim 10, wherein each of the plurality of sub-pixels comprises a plurality of light emitting units.

12. The display apparatus according to claim 11, wherein the pixel circuit comprises a plurality of light emitting circuits, and the plurality of the light emitting circuits are sequentially arranged along an extending direction of a gate line of the display apparatus.

13. The display apparatus according to claim 12, wherein the pixel circuit comprises a plurality of light emitting circuits, and the plurality of the light emitting circuits are sequentially arranged along an extending direction of a data line of the display apparatus.

14. A driving method for a pixel circuit, wherein the pixel circuit comprises a plurality of light emitting circuits:

wherein each of the light emitting circuits includes:

an input sub-circuit, configured to transmit a signal at a data voltage terminal to a latch sub-circuit, the latch sub-circuit, configured to generate a control signal in accordance with the signal at the data voltage terminal and store the control signal, and an output sub-circuit, configured to transmit one of a signal at a first voltage terminal and a signal at a second voltage terminal to a light emitting unit under control of the control signal;

the driving method includes:

providing a signal from the data voltage terminal through the input sub-circuit to the latch sub-circuit, generating and storing a control signal by the latch sub-circuit, transmitting one of the signal at the first voltage terminal and the signal at the second voltage terminal through a output sub-circuit to a light emitting unit under control of the control signal;

wherein the first voltage terminal and the second voltage terminal provide a fixed high level voltage and a fixed low level voltage to the latch sub-circuit;

the plurality of light emitting circuits comprise a first light emitting circuit and a second light emitting circuit, and the first light emitting circuit and the second light emitting circuit are configured to control a sub-pixel;

the sub-pixel comprises a first light emitting unit, a second light emitting unit, and a third light emitting unit;

the first light emitting unit and the second light emitting unit are coupled in parallel to the first light emitting circuit;

the third light emitting unit is coupled to the second light emitting circuit;

the first light emitting unit, the second light emitting unit and the third light emitting unit emit a same wavelength of light;

the first light emitting circuit and the second light emitting circuit are configured to provide voltages from the first voltage terminal and the second voltage terminal to control the sub-pixel in four grayscale states.

* * * * *